US005593053A

United States Patent [19]

Kaufman et al.

[11] Patent Number: 5,593,053

[45] Date of Patent: Jan. 14, 1997

[54] DRINKING MUG

[75] Inventors: Alan Kaufman, Lomita; Jim Podhaisky, North Hollywood, both of Calif.

[73] Assignee: Applause, Inc., Woodland Hills, Calif.

[21] Appl. No.: 306,084

[22] Filed: Sep. 14, 1994

[51] Int. Cl.[6] ..... B65D 23/02

[52] U.S. Cl. ..... 215/12.1; 229/402; 229/403

[58] Field of Search ..... 215/12.1, 13.1, 215/100 R, 100 A, 396, 398; 220/903, 425, 420; 229/400, 402, 403

[56] References Cited

U.S. PATENT DOCUMENTS

| | | | |
|---|---|---|---|
| D. 72,918 | 6/1927 | Venon . | |
| D. 165,566 | 12/1951 | Yecko | D44/9 |
| D. 258,795 | 4/1981 | Zamorski | D7/1 |
| D. 282,329 | 1/1986 | Durand | D7/8 |
| 1,221,639 | 4/1917 | Walsh | D7/1 |
| 4,040,549 | 8/1977 | Sadler | 215/100 R X |
| 4,796,937 | 1/1989 | Andrea | 215/100 A X |
| 4,936,614 | 6/1990 | Russell | 215/100 A X |
| 5,174,534 | 12/1992 | Mitchell | 215/100 R X |
| 5,335,954 | 8/1994 | Holub et al. | 215/100 A X |
| 5,366,102 | 11/1994 | Bergner et al. | 215/100 R |

FOREIGN PATENT DOCUMENTS 2023013 5/1992 United Kingdom .

*Primary Examiner*—Allan N. Shoap
*Assistant Examiner*—Christopher J. McDonald
*Attorney, Agent, or Firm*—Robbins, Berliner & Carson, LLP

[57] ABSTRACT

A drinking mug which includes a central core for holding liquid and having an outer surface. A hollow sleeve of flexible molded plastic material is disposed over the central core. The central core defines an outwardly protruding key while the inner surface of said hollow sleeve defines a keyway. The key and keyway are engaged in mating relationship to hold the sleeve non-rotationally upon the outer surface of the core.

11 Claims, 3 Drawing Sheets

DRINKING MUG

BACKGROUND OF THE INVENTION

1. Field of the Invention

This invention relates generally to drinking utensils and more particularly to drinking mugs constructed from two pieces one of which is a core and the other of which is a hollow sleeve which is held in position over the outer surface of the core.

2. Prior Art

Drinking utensils of various types are well known in the art. In the recent past it has become customary to manufacture drinking utensils utilizing an exterior which is decorated with a three-dimensional figure. It has been found that such drinking utensils in the form of mugs, tumblers, cups and the like, have become quite popular. Such three-dimensional figure mugs are used as promotional or advertising items, as items which appeal to children, items which can be used for sentimental purposes such as mascots or the emblem of a university, organization or the like.

In some instances, these prior art structures are manufactured from two pieces including a core and a sleeve which is held in place over the core. Even though these prior art structures are effective for the purpose intended, it has been found that they do not always function in the manner most acceptable. For example, in many instances, particularly where a three-dimensional representation is contained on the outer sleeve, it is considered most effective that the three-dimensional member be oriented in a specific manner. In the prior art such sleeves have traditionally been allowed to effectively float on the core member so that the three-dimensional portion can be moved thus destroying any desired orientation.

In addition, the prior art drinking utensils, particularly those in the form of a mug, known to applicants have been constructed in such a manner that the sleeve is inserted over the core and then the handle has been permanently affixed to the core thereby trapping the sleeve in place on the core.

The best prior art known to applicant is U.S. Pat. Nos. DES72,918, DES165,566, DES258,795 and DES282,329; U.S. Pat. No. 1,221,639; United Kingdom Registered Design 2023013 Registered 20 May 1992 and an advertisement in Hong Kong Enterprise of April 1983 (p. 223).

SUMMARY OF THE INVENTION

A drinking mug which includes a central core for holding liquid with a handle affixed only to the top portion thereof. A hollow sleeve received over the outer surface of the core and defining a first indexing member in an inner surface thereof. The outer surface of the hollow core includes a second indexing member which is matably received with the first indexing member of the sleeve for non-rotatably holding the sleeve on the outer surface of the hollow core.

More specifically, the second indexing member is an outwardly protruding member such as a key while the first indexing member is a recess on the inner surface of the hollow sleeve such as is a keyway within which the key fits so that the sleeve may be oriented in a predetermined manner upon the liquid holding core member for purposes of providing the desired aesthetic effect. It will also be noted that the key and keyway function not only to provide the proper orientation but also to prevent the rotation of the sleeve with respect to the core thereby maintaining a desired orientation throughout use of the drinking mug.

DETAILED DESCRIPTION OF THE PREFERRED EMBODIMENT

Figure 1:
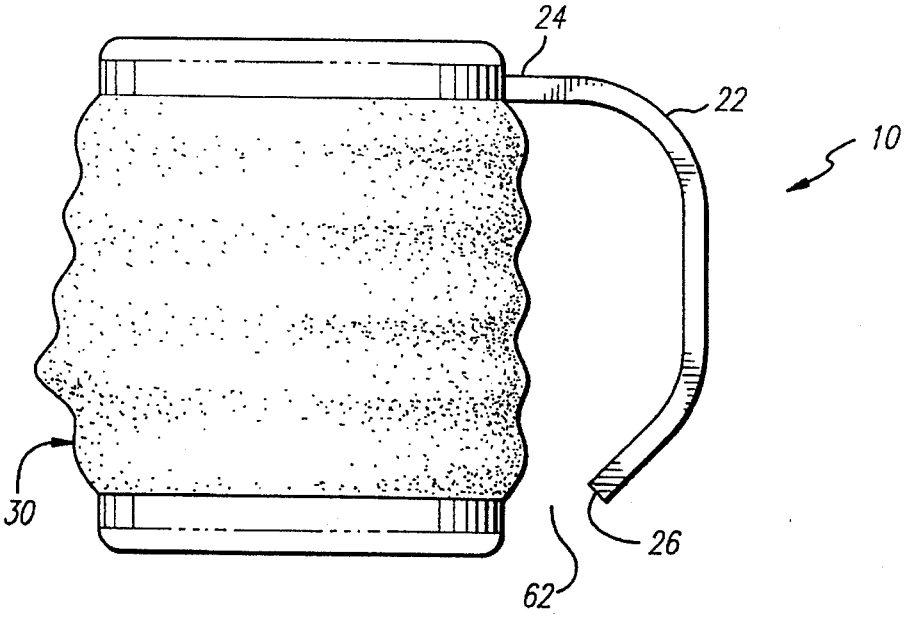
FIG. 1 is a side elevational view illustrating a drinking mug of the present invention with the sleeve in place upon the central core liquid holding member.
Figure 2:
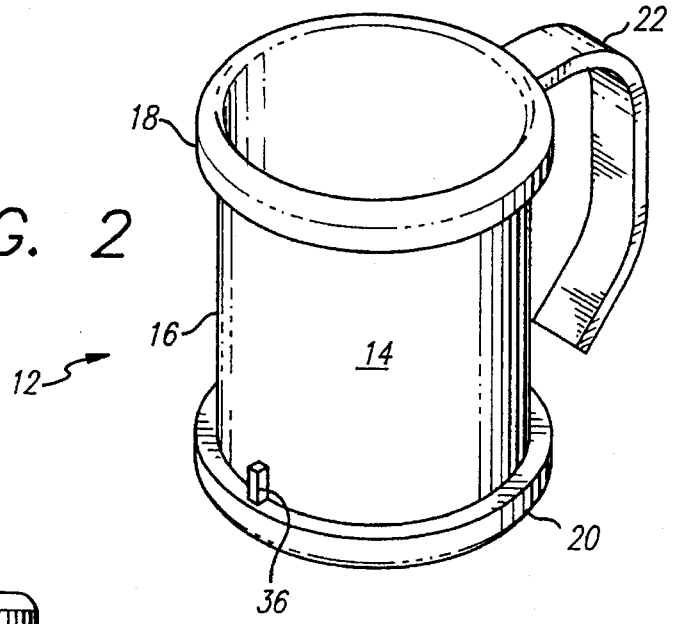
FIG. 2 is a perspective view of the central core member illustrating the positioning of the key thereon.
Figure 3:
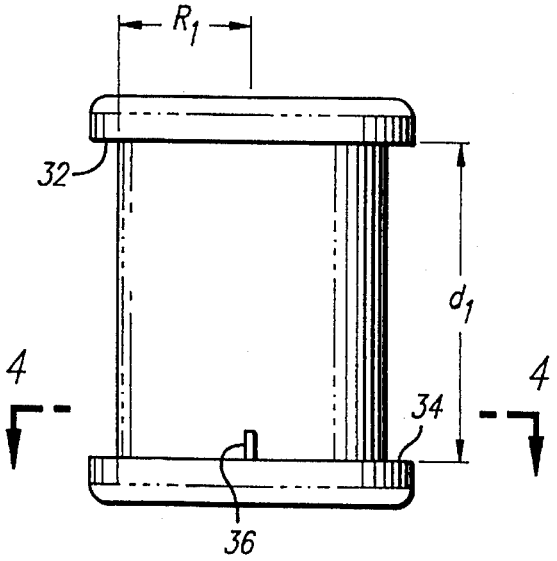
FIG. 3 is a front elevational view of the mug further showing the positioning of the key.
Figure 4:
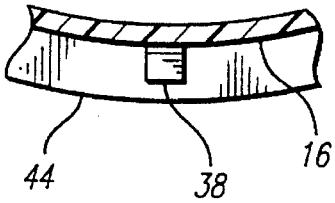
FIG. 4 is a partial cross-sectional view taken about the lines 4—4 of FIG. 3.
Figure 5:
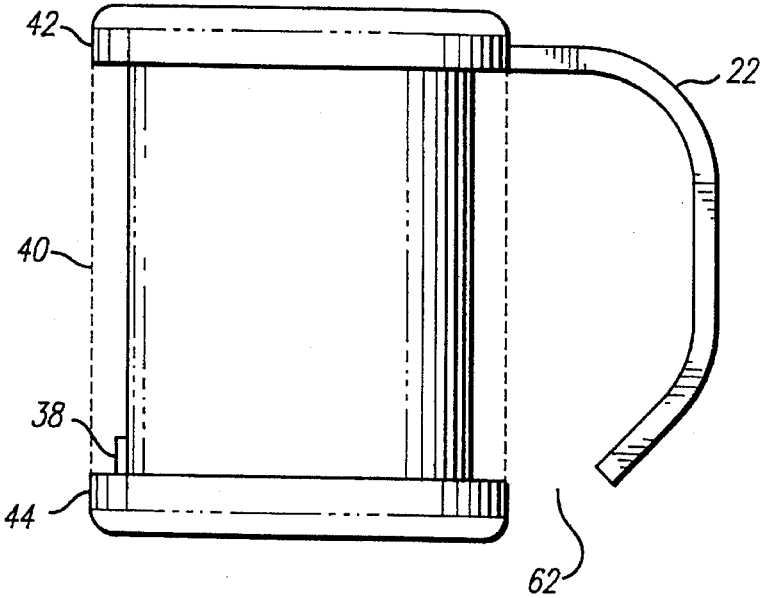
FIG. 5 is a side elevational view of the central core further illustrating the positioning of the key.

Referring now to the drawings and more particularly to FIGS. 1–5 thereof, there is shown a mug 10 constructed in accordance with the principals of the present invention. The mug 10 includes a liquid holding member 12 in the form of a central core 14 having an outer surface 16. The outer surface includes a top 18 and a bottom 20. A handle 22 is affixed only at one end 24 thereof to the top 18 of the outer surface 16. It should be noted that the opposite end 26 of the handle 22 remains unattached and is spaced from the body of the mug for a purpose to be described more fully below.

A sleeve shown generally at 30 is fitted over the central core 12 and is secured thereon by outwardly extending first and second flanges 32 and 34 respectively. To position the sleeve in a desired orientation upon central core 12 there is provided a second indexing member such as an outwardly protruding member 36 extending from the outer surface 16 of the central core 14. The outwardly protruding member 36 may take the form of a key. The key 36 extends upwardly from the flange 34 and also extends outwardly from the outer surface 16 of the mug 10. It should be noted, however, that the outer surface 38 of the key 36 is displaced inwardly from a plane 40 as shown in dash lines in FIG. 5 which is defined by the outer surfaces 42 and 44 of the top 18 and bottom 20 portions of the outer surface 16 of the central core 14. Although the key 36 is shown disposed 180° from the handle 22, it will be recognized by those skilled in the art that the angular displacement between the handle 22 and the key 36 (if any) may be any amount desired depending upon the particular relationship between the sleeve and the core. It will also be understood by those skilled in the art that although a key 36 has been illustrated and described above, that any number of keys may be utilized and such may be placed at any position upon the outer surface 16 and be either affixed to the flanges 32 and 34 or not as desired depending upon the particular structure of the sleeve 30.

Furthermore, the indexing member may take a form other than a key; for example, it may take the form of a rib, a recess or the like. Although the central core may be manufactured from any material desired, it has been found that the most effective material is a relatively rigid plastic with the central core and the handle formed as a unitary molded plastic member.

Figure 6:
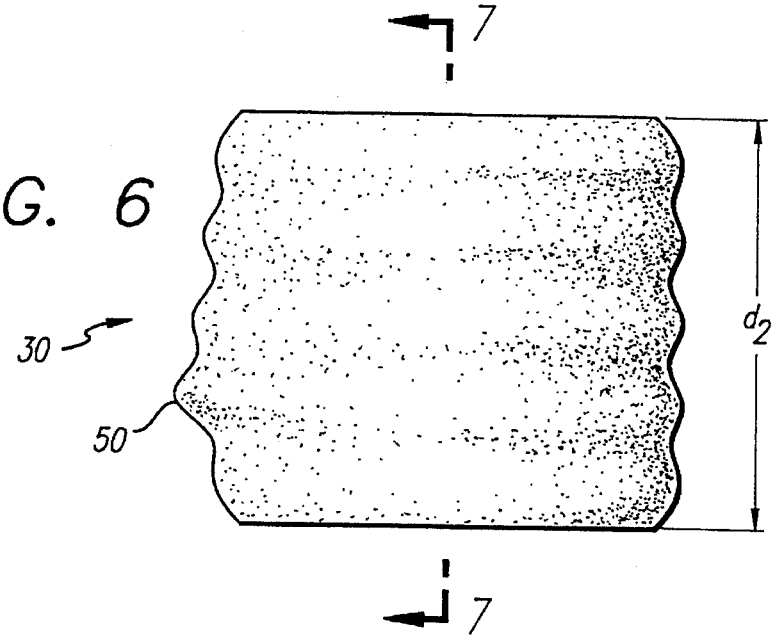
FIG. 6 is an elevational view of a hollow sleeve used in conjunction with a central core.
Figure 7:
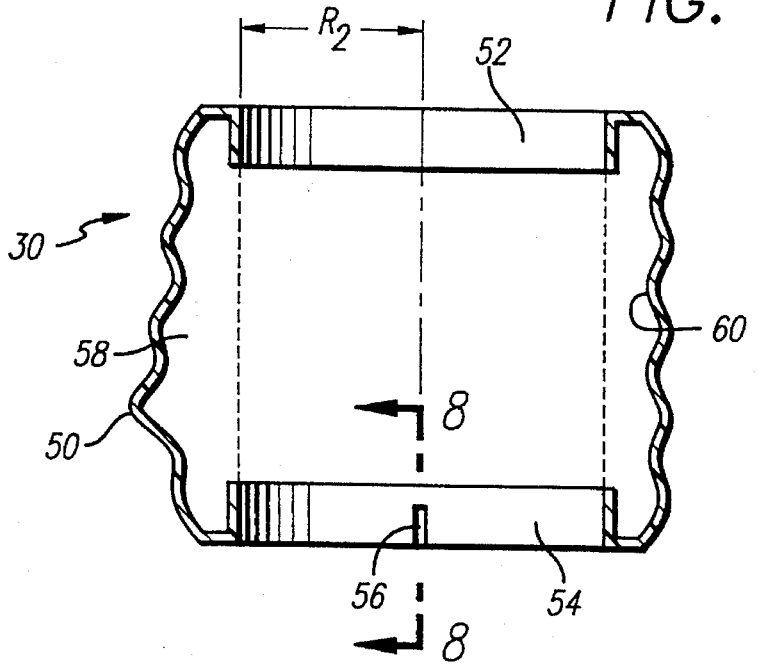
FIG. 7 is a cross-sectional view of the hollow sleeve taken about the lines 7—7 of FIG. 6.
Figure 8:
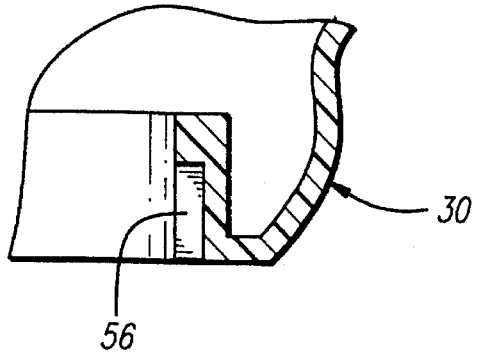
FIG. 8 is a partial cross-sectional view taken about the lines 8—8 of FIG. 7 further showing the details of a keyway formed on the inner surface of the hollow core.

By referring now more particularly to FIGS. 6, 7 and 8, the sleeve 30 which fits over the central core is illustrated in greater detail. As is evident from FIGS. 1 and 6, the sleeve 30 includes an outer surface 50 which contains a three-dimensional representation. The particular representation as shown particularly in FIGS. 1 and 6 through 9 is arbitrary and merely represents that the outer three-dimensional configuration of the sleeve may take any form desired. It, for example, has been found to be particularly appealing to children that the sleeve contain three-dimensional characterizations of cartoon or video program characters familiar to children. As a result, a child is most likely to want to purchase a drinking mug containing a three-dimensional configuration of that child's favorite TV character. As a result the particular three-dimensional configuration as shown for the sleeve 30 in the drawings is not to be taken as a limitation thereon. The length of the sleeve 30 is of a predetermined dimension d2 such that it is substantially equal to the dimension d1 between the flanges 32 and 34 on the central core 14. As a result, when the sleeve is in place on the core, the mug will appear to be a substantially unitary structure.

Figure 9:
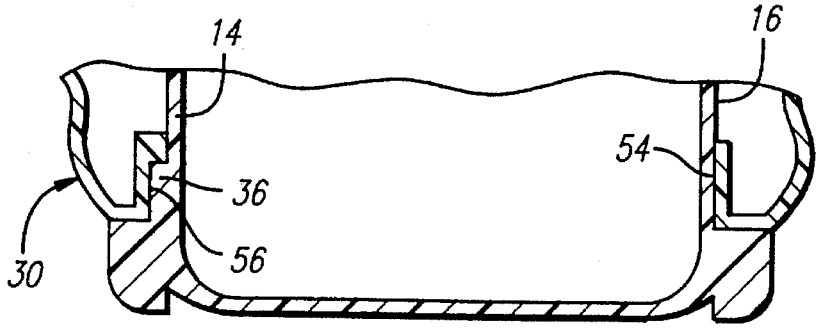
FIG. 9 is a partial cross-sectional view of the lower portion of the completed mug as shown in FIG. 1 and further illustrating in greater detail the cooperative relationship between the key and keyway.

As is shown, particularly in FIGS. 7, 8 and 9, the sleeve 30 is hollow. At the upper and lower ends of the core 30 there is formed a reentrant lip member 52 and 54. These lip members contact the outer surface 16 of the core 14 and effectively form a contact seal therewith. Provided in the lower lip is a first indexing member in the form of a recess or keyway 56. The keyway 56 extends only partially into the lip 54. As is shown more particularly in FIG. 8, the keyway extends only partially upwardly and partially outwardly from the inner surface of the lip 54. The keyway 56 in accordance with a preferred embodiment of the present invention is dimensioned so as to receive the key 36 in mating relationship therewith. It should also be noted that the radius $R_2$ of the lips 52 and 54 is substantially the same as the outer radius R1 of the central core 14. This further enables the sleeve to form a surface seal between the lips 52 and 54 and the outer surface 16 of the core 14.

The first indexing means may take any form desired other than a keyway so long as it matably engages the second indexing means on the core 14; for example it may include a plurality of keyways, elongated recesses, ribs or keys as desired for any particular application. As is shown particularly in FIG. 7 through a utilization of a sleeve having outer dimensions as illustrated there will be an inner pocket 58 of stagnant air between the outer surface 16 of the core 14 and the inner surface 60 of the sleeve 30. This pocket of stagnant air will serve to insulate the drinking mug. This will then enable the user to maintain the liquid contents of the mug either hot or cold as the case may be for a more extended period of time. Preferably the sleeve is manufactured from a pliable flexible molded plastic material. Such material allows the sleeve to be inserted over the core 14. As will be noted particularly with respect to FIGS. 1 and 5, a space 62 is provided between the end 26 of the handle 22 and the surface of the drinking mug. This space permits the placement of the sleeve from the bottom toward the top over the bottom 20 of the central core 12. When the sleeve is inserted in place, it can then be rotated so that the key 36 is received within the keyway 56 thereby orienting the sleeve in the desired position. Such orientation is shown particularly in FIG. 9. As is therein shown the key 36 is securely received within the keyway 56 thereby positioning the sleeve 30 upon the central core 14. It is also to be noted that the lip 54 engages the outer surface 16 of the central core 14.

There has thus been disclosed a drinking mug which is formed of a hollow sleeve which is disposed over a central liquid holding core and is oriented in a predetermined fashion and maintained non-rotationally thereon by mating indexing means.

What is claimed is:

1. A drinking mug comprising:

a liquid holding member having an outer surface with a top and bottom;

a first and a second radially outwardly extending continuous flange at said top and bottom respectively;

a handle affixed only to said top of said outer surface at said first flange;

a first indexing means disposed on said outer surface between said top and bottom;

a decorative hollow sleeve received upon and extending substantially the length of and covering said outer surface and having an inner surface defining a second indexing means;

said first and second indexing means being matably received one with respect to the other for non-rotatably holding said sleeve on said outer surface.

2. A drinking mug as defined in claim 1 wherein said handle is a curved member having first and second ends, said first end being affixed to said first flange with said second end disposed adjacent said second flange but spaced therefrom by an amount sufficient to permit said sleeve to be positioned over said outer surface between said flanges.

3. A drinking mug as defined in claim 2 wherein said liquid holding member and handle is formed as a unitary rigid molded plastic member and said sleeve is a flexible molded plastic sleeve.

4. A drinking mug comprising:

a liquid holding member having an outer surface with a top and bottom having a first and a second radially outwardly extending continuous flange at said top and bottom respectfully;

an outwardly extending first indexing means formed integral with and extending upwardly from said second flange;

a hollow sleeve having an inner surface defining a second indexing means;

handle means formed as a curved member having first and second ends, said first end being affixed to said first flange with said second end disposed adjacent said second flange but spaced therefrom by an amount sufficient to permit said sleeve to be positioned over said outer surface between said flanges; and said first and second indexing means being matably received one with respect to the other for non-rotatably holding said sleeve on said outer surface.

5. A drinking mug as defined in claim 4 wherein said outwardly extending first indexing means is disposed on the opposed side of said liquid holding member from said handle.

6. A drinking mug comprising:

a liquid holding member having an outer surface with a top and bottom having a first and a second radially outwardly extending continuous flange at said top and bottom respectively, each of said flanges having an outermost surface;

a first indexing means disposed on said outer surface between said top and bottom;

the outermost surfaces of said first and second flanges being disposed in a common plane extending between said first and second flanges and said first indexing means including an outer surface spaced inwardly from said plane;

a hollow sleeve having an inner surface defining a second indexing means;

handle means formed as a curved member having first and second ends, said first end being affixed to said first flange with said second end disposed adjacent said second flange but spaced therefrom by an amount sufficient to permit said sleeve to be positioned over said outer surface between said flanges; and said first and second indexing means being matably received one with respect to other for non-rotatably holding said sleeve on said outer surface.

7. A drinking mug as defined in claim 6 wherein said liquid holding member and handle is formed as a unitary rigid molded plastic member and said sleeve is a flexible molded plastic sleeve and said sleeve includes upper and lower re-entrant lips for engaging said outer surface of said liquid holding member.

8. A drinking mug as defined in claim 7 wherein said second indexing means is formed in one of said first and second lips.

9. A drinking mug as defined in claim 8 wherein said sleeve inner surface is spaced from said outer surface of said liquid holding member to thereby define stagnant air space for insulation of said mug.

10. A drinking mug as defined in claim 9 wherein said liquid holding member is cylindrical and said outer surface has a first predetermined radius and said sleeve is cylindrical and said lips have a second predetermined radius, said first and second radius being substantially equal.

11. A drinking mug s defined in claim 10 wherein the distance between said first and second flanges is a first predetermined distance and the length of said sleeve is a second predetermined distance, said first and second predetermined distances being substantially equal.

* * * * *